US010143901B2

(12) United States Patent
Nakamura

(10) Patent No.: US 10,143,901 B2
(45) Date of Patent: Dec. 4, 2018

(54) GOLF CLUB SHAFT

(71) Applicant: DUNLOP SPORTS CO. LTD., Kobe-shi, Hyogo (JP)

(72) Inventor: Hirotaka Nakamura, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/457,146

(22) Filed: Mar. 13, 2017

(65) Prior Publication Data

US 2017/0259138 A1 Sep. 14, 2017

(30) Foreign Application Priority Data

Mar. 14, 2016 (JP) ..... 2016-049234

(51) Int. Cl.
*A63B 53/10* (2015.01)

(52) U.S. Cl.
CPC ..... *A63B 53/10* (2013.01)

(58) Field of Classification Search
USPC ..... 473/316–323
See application file for complete search history.

(56) References Cited

U.S. PATENT DOCUMENTS 5,326,099 A * 7/1994 Yamamoto ..... A63B 53/02 273/DIG. 23
5,437,450 A * 8/1995 Akatsuka ..... A63B 53/10 273/DIG. 23
5,968,621 A * 10/1999 Okada ..... A01K 87/00 428/36.3
6,306,047 B1 * 10/2001 Kusumoto ..... A63B 53/10 428/36.3
6,875,127 B2 * 4/2005 Hasegawa ..... A63B 53/10 473/319
7,326,125 B2 * 2/2008 Moriyama ..... A63B 53/00 473/292
8,021,244 B2 * 9/2011 Kato ..... A63B 53/10 473/319
8,262,500 B2 * 9/2012 Nakamura ..... A63B 53/10 473/319
8,491,410 B2 * 7/2013 Kato ..... A63B 53/10 473/319

(Continued)

FOREIGN PATENT DOCUMENTS

JP 2009-60983 A 3/2009

*Primary Examiner* — Alvin Hunter
(74) *Attorney, Agent, or Firm* — Birch, Stewart, Kolasch & Birch, LLP

(57) ABSTRACT

A shaft 6 includes a plurality of layers formed by fiber reinforced resins. The layers include a hoop layer and bias layers. The hoop layer includes a full length hoop layer s9 constituted with a prepreg having a fiber elastic modulus of equal to or greater than 30 (tf/mm$^2$) and having a fiber weight per unit area of equal to or greater than 50 (g/m$^2$) but equal to or less than 80 (g/m$^2$). The bias layers s2, s3, s4, and s5 include high elasticity containing bias layers s4 and s5 constituted with a prepreg contacting a high elastic pitch-based carbon fiber having a fiber elastic modulus of equal to or greater than 80 (tf/mm$^2$). Preferably, the full length hoop layer s9 is disposed outside the high elasticity containing bias layers s4 and s5.

13 Claims, 8 Drawing Sheets

(56) References Cited

U.S. PATENT DOCUMENTS

| | | | | |
|---|---|---|---|---|
| 8,827,829 | B2 * | 9/2014 | Nakano | A63B 53/10<br>473/319 |
| 2009/0029792 | A1 | 1/2009 | Kumamoto | |
| 2013/0165250 | A1 | 6/2013 | Takeuchi | |

* cited by examiner

GOLF CLUB SHAFT

The present application claims priority on Patent Application No. 2016-049234 filed in JAPAN on Mar. 14, 2016, the entire contents of which are hereby incorporated by reference.

BACKGROUND OF THE INVENTION

Field of the Invention

The present invention relates to a golf club shaft.

Description of the Related Art

In shafts obtained using prepregs, bias layers are usually used. In light of crushing rigidity or the like, shafts including hoop layers are known.

Japanese Patent Application Laid-Open Publication No. 2009-22622 (US2009/0029792) discloses a constitution including a partial hoop layer in addition to a full length hoop layer.

Japanese Patent Application Laid-Open Publication No. 2009-60983 discloses a constitution including two bias layers and a hoop layer disposed at a position where the hoop layer is brought into contact with an outer bias layer of the two bias layers.

Japanese Patent Application Laid-Open Publication No. 2013-150775 (US2013/0165250) discloses a constitution including three bias layers. One bias layer of the three bias layers includes a pitch-based carbon fiber, and the remaining two bias layers include a PAN-based carbon fiber.

SUMMARY OF THE INVENTION

It has become clear that the behavior of a shaft during swing is optimized by more optimally disposing a hoop layer having a specific specification. Furthermore, it became clear that a non-conventional synergistic effect is obtained by combining the hoop layer with a specific bias layer. As a result, both a high head speed and directional stability can be achieved by combining the hoop layer with the bias layer.

The present embodiments provide golf club shafts which can achieve a high head speed and directional stability.

In one aspect, A shaft includes a plurality of layers formed by fiber reinforced resins. The plurality of layers include a hoop layer and a bias layer. The hoop layer includes a full length hoop layer constituted with a prepreg having a fiber elastic modulus of equal to or greater than 30 (tf/mm$^2$) and having a fiber weight per unit area of 50 (g/m$^2$) or greater but 80 (g/m$^2$) or less. The bias layer includes a high elasticity containing bias layer constituted with a prepreg containing a high elastic pitch-based carbon fiber having a fiber elastic modulus of equal to or greater than 80 (tf/mm$^2$).

In another aspect, the full length hoop layer is disposed outside the high elasticity containing bias layer.

Preferably, the hoop layer is constituted with only the one full length hoop layer.

In another aspect, a fiber elastic modulus of the full length hoop layer is 33 (tf/mm$^2$) or greater but 40 (tf/mm$^2$) or less.

In another aspect, the fiber elastic modulus of the high elastic pitch-based carbon fiber is equal to or greater than 90 (tf/mm$^2$).

In another aspect, the high elasticity containing bias layer is constituted with a prepreg containing the high elastic pitch-based carbon fiber having a fiber elastic modulus of equal to or greater than 80 (tf/mm$^2$) and a carbon fiber having a fiber elastic modulus of equal to or less than 40 (tf/mm$^2$).

In another aspect, the high elasticity containing bias layer is constituted with a prepreg containing the high elastic pitch-based carbon fiber and a PAN-based carbon fiber.

DESCRIPTION OF THE PREFERRED EMBODIMENTS

The present disclosure will be described later in detail based on preferred embodiments with appropriate reference to the drawings.

In the present application, an "axial direction" means an axial direction of a shaft. In the present application, a "radial direction" means a radial direction of the shaft. In the present application, an "outside" means an outside in the radial direction. In the present application, an "inside" means an inside in the radial direction. In the present application, a "region" means a region in the axial direction.

Figure 1:
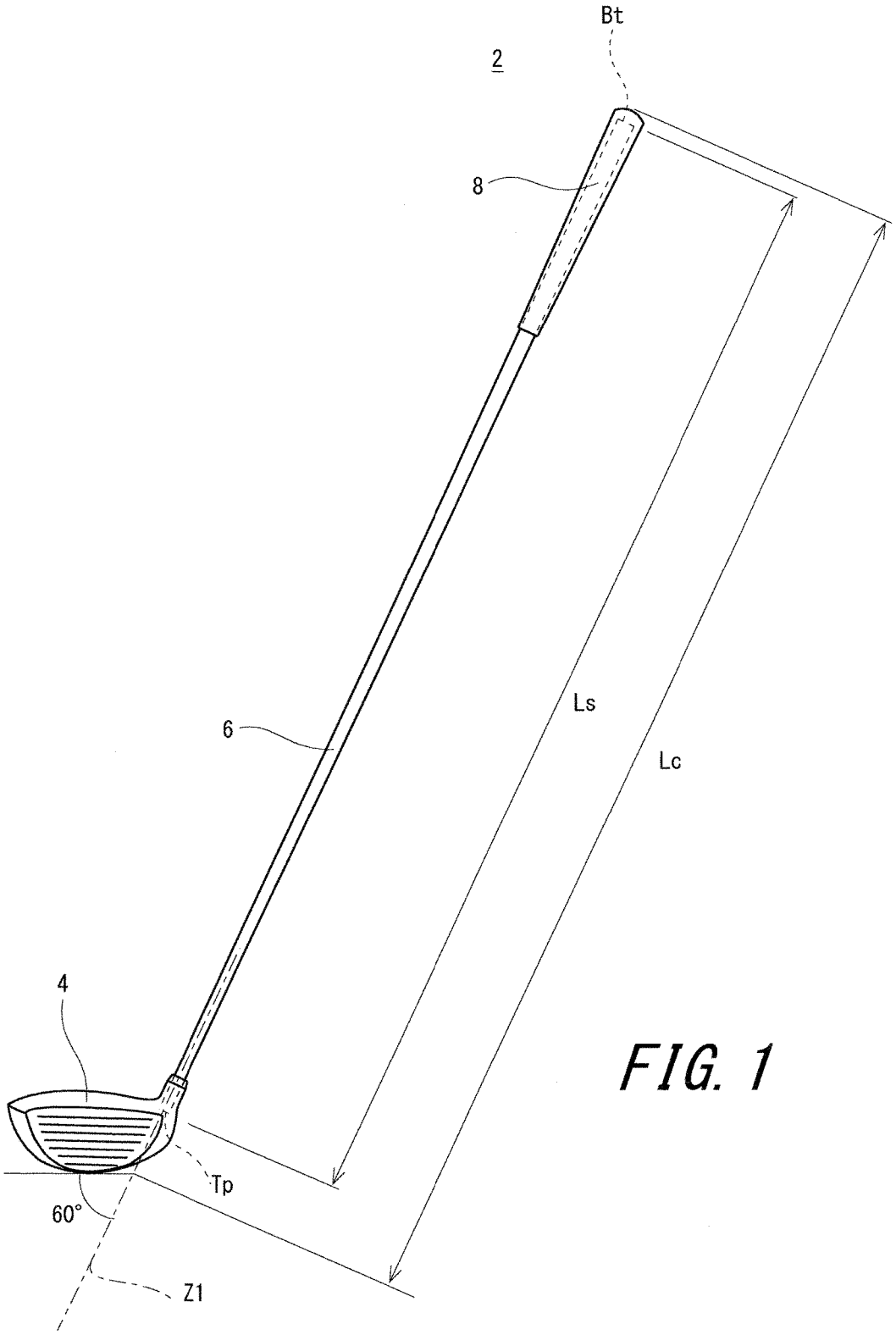
FIG. 1 shows a golf club including a shaft according to a first embodiment.

FIG. 1 shows a golf club 2 according to a first embodiment. The golf club 2 includes a head 4, a shaft 6, and a grip 8. The shaft 6 has a taper shape. The shaft 6 includes a tip end Tp and a butt end Bt. The outer diameter of the tip end Tp is less than the outer diameter of the butt end Bt. The head 4 is attached to the tip end of the shaft 6. The grip 8 is attached to the butt end of the shaft 6. The head 4 has a hollow structure. The head 4 is a wood-type head. The golf club 2 is a driver (number 1 wood).

A long shaft is advantageous in order to improve the effect of the shaft 6 to be described later. In this respect, the golf club 2 has a length Lc of preferably equal to or longer than 43 inches, more preferably equal to or longer than 44 inches, and still more preferably equal to or longer than 45 inches. In light of easiness of swing, the length Lc of the golf club 2 is preferably equal to or shorter than 48 inches, and more preferably equal to or shorter than 47 inches. In light of flight distance, a preferable head 4 is a wood-type golf club head. Preferably, the golf club 2 is a wood-type golf club.

The length Lc of the golf club 2 is measured based on "1c Length" in "1 Clubs" of "Appendix II Design of Clubs" in the Golf Rules defined by R&A (Royal and Ancient Golf Club of Saint Andrews). In the measurement, a sole is made to abut on a flat plate having an angle of 60 degrees with respect to a shaft axis line Z1. The method for measuring the club length Lc is referred to as a 60-degrees method.

A shaft length is shown by a double-pointed arrow Ls in FIG. 1. The shaft length Ls is a distance between a tip end Tp and a butt end Bt. The distance is measured along the axial direction.

A tip part of the shaft 6 is inserted into a hosel hole of the head 4. The axial-direction length of a portion of the shaft 6 inserted into the hosel hole is usually 25 mm or greater but 70 mm or less.

The shaft 6 is a tubular body. The shaft 6 is a laminate of fiber reinforced resin layers. The shaft 6 is a so-called carbon shaft.

The shaft 6 is formed by curing a wound prepreg. In a typical prepreg, fibers are oriented substantially in one direction. The prepreg is also referred to as a UD prepreg. The term "UD" stands for uni-direction. Prepregs which are not the UD prepreg may be used. For example, fibers contained in the prepreg may be woven.

The prepreg has a fiber and a resin. The resin is also referred to as a matrix resin. Typically, the fiber is a carbon fiber. Typically, the matrix resin is a thermosetting resin.

The shaft 6 is manufactured by a so-called sheet-winding method. In the prepreg, the matrix resin is in a semi-cured state. The shaft 6 is obtained by winding and curing the prepreg.

The matrix resin may be a thermosetting resin, or may be a thermoplastic resin. Typical examples of the matrix resin include an epoxy resin. In light of shaft strength, the matrix resin is preferably an epoxy resin.

Examples of the fiber include a carbon fiber, a glass fiber, an aramid fiber, a boron fiber, an alumina fiber, and a silicon carbide fiber. Two or more of the fibers may be used in combination. In light of the shaft strength, the fiber is preferably the carbon fiber and the glass fiber, and more preferably the carbon fiber. Examples of the carbon fiber include a PAN-based carbon fiber and a pitch-based carbon fiber.

Figure 2:
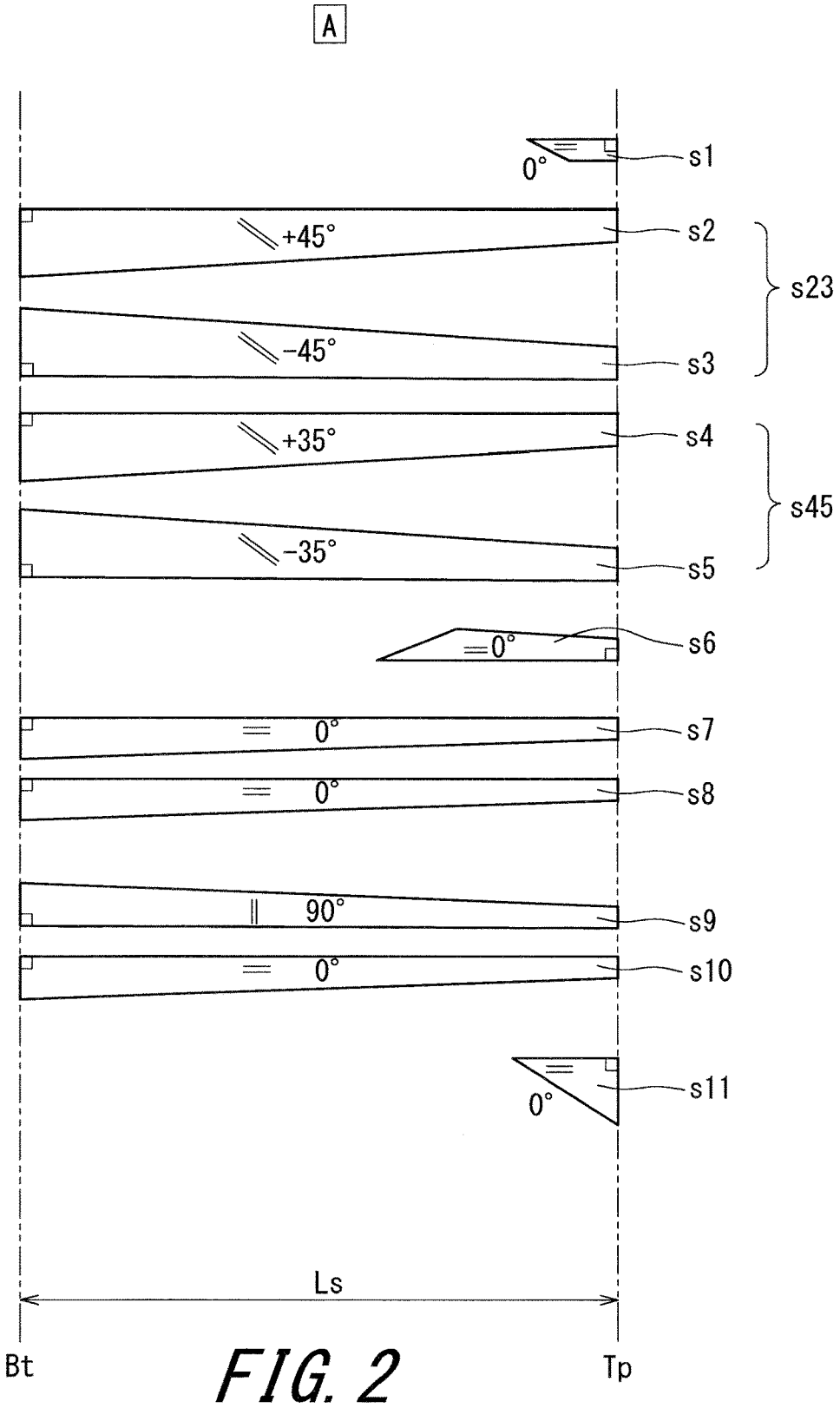
FIG. 2 is a developed view showing the laminated constitution of the shaft according to the first embodiment, and shows a laminated constitution A.

FIG. 2 is a developed view (laminated constitution view) of prepregs constituting the shaft 6. In the present application, the prepreg is also merely referred to as a sheet.

The shaft 6 is constituted with a plurality of sheets. The shaft 6 is constituted with eleven sheets of a first sheet s1 to an eleventh sheet s11. The developed view shows the sheets constituting the shaft in order from inside. The sheets are wound in order from the sheet located on the uppermost side in the developed view. In the developed view, the horizontal direction of the figure coincides with the axial direction of the shaft. In the developed view, the right side of the figure is the tip end Tp side. In the developed view, the left side of the figure is the butt end Bt side.

The developed view shows not only the winding order of the sheets but also the disposal of each of the sheets in the axial direction of the shaft. For example, in FIG. 2, an end of the first sheet s1 is located at the tip end Tp.

The term "layer" and the term "sheet (or prepreg)" are used in the present application. The "layer" is a term for after being wound. Meanwhile, the "sheet" is a term for before being wound. The "layer" is formed by winding the "sheet". That is, the wound "sheet" forms the "layer". In the present application, the same symbol is used in the layer and the sheet. For example, a layer formed by a sheet s1 is a layer s1.

The shaft 6 includes a straight layer, a bias layer, and a hoop layer. An orientation angle Af of the fiber is described for each of the sheets in the developed view of the present application. The orientation angle Af is an angle with respect to the shaft axis direction. In the present application, the term "absolute angle θa" is also used. The absolute angle θa is the absolute value of the orientation angle Af.

A sheet described as "0 degree (0°)" constitutes the straight layer. The sheet constituting the straight layer is also referred to as a straight sheet. The straight layer is highly correlated with flexural rigidity and flexural strength.

The straight layer is a layer in which the angle Af is substantially set to 0 degree. Usually, the angle Af is not completely set to 0 degree due to error or the like in winding. Usually, in the straight layer, an absolute angle θa is equal to or less than 10 degrees. "The absolute angle θa is equal to or less than 10 degrees" means that "the angle Af is −10 degrees or greater and +10 degrees or less".

In the embodiment of FIG. 2, the straight sheets are the sheet s1, the sheet s6, the sheet s7, the sheet s8, the sheet s10, and the sheet s11.

The bias layer is highly correlated with the torsional rigidity and the torsional strength of the shaft. Usually, a bias sheet constitutes a sheet pair including two sheets in which orientations of fibers are inclined in opposite directions to each other. In light of the torsional rigidity, the absolute angle θa of the bias layer is preferably equal to or greater than 15 degrees, more preferably equal to or greater than 25 degrees, and still more preferably equal to or greater than 35 degrees. In light of the torsional rigidity and flexural rigidity, the absolute angle θa of the bias layer is preferably equal to or less than 60 degrees, and more preferably equal to or less than 50 degrees.

The shaft 6 includes a plurality of (two) bias layers. In the shaft 6, the sheets constituting the bias layer are a second sheet s2, a third sheet s3, a fourth sheet s4, and a fifth sheet s5. As described above, in FIG. 2, the angle Af is described in each sheet. The plus (+) and the minus (−) in the angle Af show that the fibers of bias sheets are inclined in opposite directions to each other. The sheet s2 and the sheet s3 constitute a united sheet (first united sheet) to be described later. The sheet s4 and the sheet s5 constitute a united sheet (second united sheet) to be described later.

In FIG. 2, the inclination direction of the fiber of the sheet s3 is equal to the inclination direction of the fiber of the sheet s2. However, the sheet s3 is reversed, and applied on the sheet s2. As a result, the direction of the angle Af of the sheet s2 and the direction of the angle Af of the sheet s3 are opposite to each other. In light of this point, in the embodiment of FIG. 5, the angle Af of the sheet s2 is described as +45 degrees and the angle Af of the sheet s3 is described as −45 degrees.

In FIG. 2, the inclination direction of the fiber of the sheet s5 is equal to the inclination direction of the fiber of the sheet s4. However, the sheet s5 is reversed, and applied on the sheet s4. As a result, the direction of the angle Af of the sheet s4 and the direction of the angle Af of the sheet s5 are opposite to each other. In light of this point, in the embodiment of FIG. 2, the angle Af of the sheet s4 is described as +35 degrees and the angle Af of the sheet s5 is described as −35 degrees.

The shaft 6 includes two pairs of bias layers. A first bias layer s23 is constituted with the sheet s2 and the sheet s3. A second bias layer s45 is constituted with the sheet s4 and the sheet s5. The second bias layer s45 is positioned outside the first bias layer s23. The first bias layer s23 is also referred to as an inner bias layer. The second bias layer s45 is also referred to as an outer bias layer. Three or more pairs of bias layers may be provided.

The fiber angle (absolute angle θa) of the inner bias layer s23 is 45 degrees. The fiber angle (absolute angle θa) of the outer bias layer s45 is 35 degrees. The fiber angle (absolute angle θa) of the outer bias layer s45 is less than the fiber angle (absolute angle θa) of the inner bias layer s23. As described later, the outer bias layer s45 is a high elasticity containing bias layer. The fiber angle (absolute angle θa) of the high elasticity containing bias layer s45 is less than 45 degrees. The fiber angle (absolute angle θa) of the high elasticity containing bias layer s45 is equal to or less than 40 degrees. The high elasticity containing bias layer in which the fiber angle is less than 45 degrees contributes to not only torsional rigidity but also flexural rigidity. The high elasticity containing bias layer in which the fiber angle is less than 45 degrees contributes to not only torsional strength but also flexural strength. Therefore, a lightweight shaft having high strength can be obtained.

In light of torsional breaking strength, the fiber elastic modulus of the inner bias layer s23 is preferably less than the fiber elastic modulus of the outer bias layer s45. Preferably, the fiber elastic modulus of the inner bias layer s23 is preferably equal to or less than 46 (tf/mm$^2$), and more preferably equal to or less than 40 (tf/mm$^2$). In light of torsional rigidity, the fiber elastic modulus of the inner bias layer s23 is preferably equal to or greater than 30 (tf/mm$^2$). In light of torsional rigidity, the fiber angle (absolute angle θa) of the inner bias layer s23 is preferably 40 degrees or greater but 50 degrees or less.

The shaft 6 includes a hoop layer. The shaft 6 includes one hoop layer. In the shaft 6, the hoop layer is a layer s9. In the shaft 6, the sheet constituting the hoop layer is a ninth sheet s9. In the present application, the sheet constituting the hoop layer is also referred to as a hoop sheet.

Preferably, the absolute angle θa in the hoop layer is substantially 90 degrees to the axis line of the shaft. However, the orientation direction of the fiber to the axial direction of the shaft may not be completely set to 90 degrees due to an error or the like in winding. In the hoop layer, the angle Af is usually −90 degrees or greater and −80 degrees or less, or 80 degrees or greater and 90 degrees or less. In other words, in the hoop layer, the absolute angle θa is usually 80 degrees or greater and 90 degrees or less.

In light of suppressing winding fault such as wrinkles, a sheet having a too large width is not preferable. In this respect, the number of plies of one bias sheet is preferably equal to or less than 4, and more preferably equal to or less than 3. In light of the working efficiency of the winding process, the number of plies of the bias sheet is preferably equal to or greater than 1.

The number of plies means the number of windings. For example, when one sheet is wound just one round, the number of plies is 1.

In light of suppressing winding fault such as wrinkles, a sheet having a too large width is not preferable. In this respect, the number of plies of one straight sheet is preferably equal to or less than 4, more preferably equal to or less than 3, and still more preferably equal to or less than 2. In light of the working efficiency of the winding process, the number of plies of the straight sheet is preferably equal to or greater than 1. The number of plies may be 1 in all the straight sheets.

In a full length sheet, winding fault is apt to occur. In light of suppressing the winding fault, the number of plies of one sheet in all full length straight sheets is preferably equal to or less than 2. The number of plies may be 1 in all the full length straight sheets.

In light of suppressing winding fault such as wrinkles, a sheet having a too large width is not preferable. In this respect, the number of plies of one hoop sheet is preferably equal to or less than 4, more preferably equal to or less than 3, and more preferably equal to or less than 2. In light of the working efficiency of the winding process, the number of plies of one hoop sheet is preferably equal to or greater than 1. In all the hoop sheets (hoop layers), the number of plies may be equal to or less than 2. In the hoop sheet s9 of the embodiment of FIG. 2, the number of plies is 1.

In a full length sheet, winding fault is apt to occur. In light of suppressing the winding fault, the number of plies of one sheet in the full length hoop sheet is preferably equal to or less than 2. More preferably, the number of plies is 1 in the full length hoop sheet.

In the embodiment of FIG. 2, a united sheet is formed. The united sheet is formed by stacking two or more sheets.

In the embodiment of FIG. 2, three united sheets are formed. A first united sheet is formed by stacking the sheet s2 and the sheet s3. The first bias layer s23 is formed by winding the first united sheet. A second united sheet is formed by stacking the sheet s4 and the sheet s5. The second bias layer s45 is formed by winding the second united sheet.

A third united sheet is formed by stacking the sheet s9 and the sheet s10. The hoop sheet s9 is wound in a state of the united sheet. The winding fault of the hoop sheet is suppressed by the winding method.

As described above, in the present application, the sheet and the layer are classified by the orientation angle of the fiber. Furthermore, in the present application, the sheet and the layer are classified by the axial-direction length of the shaft.

In the present application, a layer substantially wholly disposed in the axial direction of the shaft is referred to as a full length layer. In the present application, a sheet substantially wholly disposed in the axial direction of the shaft is referred to as a full length sheet. The wound full length sheet forms the full length layer.

A region between the tip end Tp and a point of 50 mm distant from the tip end Tp in the axial direction is defined as a first region. A region between the butt end Bt and a point of 150 mm distant from the butt end Bt in the axial direction is defined as a second region. The first region and the second region have a limited influence on the performance of the shaft. In this respect, the full length sheet may not be present in the first region and the second region. Preferably, the full length sheet extends from the tip end Tp to the butt end Bt. In other words, the full length sheet is preferably wholly disposed in the axial direction of the shaft.

In the present application, a layer partially disposed in the axial direction of the shaft is referred to as a partial layer. In the present application, a sheet partially disposed in the axial direction of the shaft is referred to as a partial sheet. The wound partial sheet forms the partial layer. The axial-direction length of the partial sheet is shorter than the axial-direction length of the full length sheet. The axial-direction length of the partial sheet may be equal to or less than half of the full length of the shaft.

In the present application, the full length layer that is the straight layer is referred to as a full length straight layer. In the embodiment of FIG. 2, the full length straight layers are a layer s7, a layer s8, and a layer s10. The full length straight sheets are the sheet s7, the sheet s8, and the sheet s10.

In the present application, the full length layer which is the hoop layer is referred to as a full length hoop layer. In the embodiment of FIG. 2, the full length hoop layer is a layer s9. The full length hoop sheet is a sheet s9. In the present embodiment, the number of the full length hoop layers s9 is 1. The number of the full length hoop layers may be equal to or greater than 2. In the present embodiment, the number of the full length hoop sheets s9 (prepreg s9 constituting the full length hoop layer) is 1. The number of the full length hoop sheets may be equal to or greater than 2. The full length hoop layer s9 is disposed outside all the bias layers s2, s3, s4, and s5.

In the present application, the partial layer that is the straight layer is referred to as a partial straight layer. In the embodiment of FIG. 2, the partial straight layers are a layer s1, a layer s6, and a layer s11. Partial straight sheets are the sheet s1, the sheet s6, and the sheet s11.

In the present application, the partial layer that is the hoop layer is referred to as a partial hoop layer. The embodiment of FIG. 2 does not have the partial hoop layer. The partial hoop layer may be used.

The term "tip partial layer" is used in the present application. An axial-direction distance between the tip partial layer (tip partial sheet) and the tip end Tp is preferably equal to or less than 40 mm, more preferably equal to or less than 30 mm, still more preferably equal to or less than 20 mm, and yet still more preferably 0 mm. In the embodiment, the distance is 0 mm.

Examples of the tip partial layer include a tip partial straight layer. In the embodiment of FIG. 2, the tip partial straight layers are the layer s1, the layer s6, and the layer s11. The tip partial straight sheets are the sheet s1, the sheet s6, and the sheet s11. The tip partial layer increases the strength of the tip portion of the shaft 6.

The term "butt partial layer" is used in the present application. The embodiment of FIG. 2 includes no butt partial layer. The butt partial layer may be provided.

The shaft 6 is produced by the sheet-winding method using the sheets shown in FIG. 2.

Hereinafter, a manufacturing process of the shaft 6 will be schematically described.

[Outline of Manufacturing Process of Shaft]

(1) Cutting Process

The prepreg is cut into a desired shape in the cutting process. Each of the sheets shown in FIG. 2 is cut out by the process.

The cutting may be performed by a cutting machine. The cutting may be manually performed. In the manual case, for example, a cutter knife is used.

(2) Stacking Process

In the stacking process, the three united sheets described above are produced.

In the stacking process, heating or a press may be used. More preferably, the heating and the press are used in combination. In a winding process to be described later, the deviation of the sheet may be generated during the winding operation of the united sheet. The deviation reduces winding accuracy. The heating and the press improve an adhesive force between the sheets. The heating and the press suppress the deviation between the sheets in the winding process.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The sheets (prepregs) are wound in order described in the developed view. The sheet located on a more upper side in the developed view is earlier wound. The sheets to be stacked are wound in a state of the united sheet.

A winding body is obtained in the winding process. The winding body is obtained by winding the prepreg around the outside of the mandrel. For example, the winding is achieved by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The tape is wrapped while tension is applied to the tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel in light of improving the efficiency of the process of removing the wrapping tape.

(7) Process of Cutting Both Ends

Both the end parts of the cured laminate are cut in the process. The cutting flattens the end face of the tip end Tp and the end face of the butt end Bt.

In order to facilitate the understanding, in all the developed views of the present application, the sheets after both the ends are cut are shown. In fact, the cutting of both the ends is considered in the size in cutting. That is, in fact, the cutting is performed in a state where the sizes of both end portions to be cut are added.

(8) Polishing Process

The surface of the cured laminate is polished in the process. Spiral unevenness is present on the surface of the cured laminate. The unevenness is the trace of the wrapping tape. The polishing extinguishes the unevenness to smooth the surface of the cured laminate. Preferably, whole polishing and tip partial polishing are conducted in the polishing process.

(9) Coating Process

The cured laminate after the polishing process is subjected to coating.

The shaft 6 is obtained in the processes. The shaft 6 is lightweight, and has excellent strength.

As described above, the shaft 6 includes the hoop layer s9. The hoop layer s9 is disposed over the full length of the shaft 6. The hoop layer s9 is the full length hoop layer.

The fiber elastic modulus of the prepreg constituting the hoop layer s9 is equal to or greater than 30 ($tf/mm^2$). The fiber weight per unit area of the prepreg constituting the hoop layer s9 is 50 ($g/m^2$) or greater but 80 ($g/m^2$) or less. The fiber weight per unit area means the weight of fibers per square meter.

The fiber weight per unit area of equal to or greater than 50 ($g/m^2$) is excessive when the prepreg is used for the hoop layer. The fiber weight per unit area of the hoop layer is conventionally equal to or less than 30 ($g/m^2$). As described above, the hoop layer is provided for crushing rigidity. In order to improve the crushing rigidity, the fiber weight per unit area of the hoop layer is sufficient if it is equal to or less than 30 ($g/m^2$). The hoop layer hardly contributes to flexural rigidity (flexural strength) and torsional rigidity (torsional strength). Therefore, it has been a common technical knowledge to persons skilled in the art that an increase in the fiber weight per unit area of the hoop layer merely causes only a heavy shaft. The increase in the fiber weight per unit area of the hoop layer has been contrary to a common technical knowledge to persons skilled in the art.

Since the fiber is oriented at 90 degrees with respect to the axis line of the shaft, the hoop layer is less likely to be wound. In other words, the hoop layer has low winding property. The fiber is predisposed into a straight. The predisposition causes the fiber bent in a circumferential direction to return to an original state. For this reason, a phenomenon occurs, in which the winding of the prepreg wound once is released.

If the fiber weight per unit area of the hoop layer is greater than the fiber weight per unit area of the conventional hoop layer, and equal to or greater than 50 (g/m$^2$), the winding property is further deteriorated. The hoop layer having a fiber weight per unit area greater than the fiber weight per unit area of the conventional hoop layer is further less likely to be wound. Also in this respect, the increase in the fiber weight per unit area of the hoop layer has been contrary to a common technical knowledge to persons skilled in the art.

Thus, in view of the plurality of common technical knowledges, persons skilled in the art have not increased the fiber weight per unit area of the hoop layer. However, in the present disclosure, it has been found that an effect is obtained by increasing the fiber weight per unit area of the hoop layer.

In the initial stage of downswing, stress is concentrated on the hand side (portion close to the grip) of the shaft 6. For this reason, in the hand portion, the shaft 6 is flexed, and crushing deformation occurs. The crushing deformation is interlocked with flexure. Crushing rigidity on the hand side of the shaft 6 is increased by the hoop layer constituted with the prepreg having a fiber weight per unit area of equal to or greater than 50 (g/m$^2$), which promotes flexure return. The flexure return is a phenomenon in which flexure to a rear side in the direction of movement of swing returns to an original state, and contributes to an increase in a head speed.

In light of the flexure return, the fiber elastic modulus of the full length hoop layer is preferably equal to or greater than 30 (tf/mm$^2$), and more preferably equal to or greater than 33 (tf/mm$^2$). When the fiber elastic modulus is excessive, the winding property is deteriorated. Since the curvature radius of a small-diameter portion (tip portion) is particularly decreased, the winding property is deteriorated. Therefore, in this case, by providing a partial hoop layer only in a rear end portion without providing the hoop layer in the tip portion, the winding property can be improved. However, in the partial hoop layer, the effect of the flexure return ends, and a sufficient effect is not obtained over the full length of the shaft 6. If the fiber elastic modulus of the full length hoop layer is excessive, the crushing rigidity becomes excessive. Flexure interlocked with the crushing deformation may be suppressed by the excessive crushing rigidity. As a result, the flexure return may be decreased. In these respects, the fiber elastic modulus of the full length hoop layer is preferably equal to or less than 40 (tf/mm$^2$), and more preferably equal to or less than 35 (tf/mm$^2$).

In light of the flexure return, the fiber weight per unit area of the prepreg constituting the full length hoop layer is preferably equal to or greater than 50 (g/m$^2$), and more preferably equal to or greater than 55 (g/m$^2$). In light of the winding property, the fiber weight per unit area of the prepreg constituting the full length hoop layer is preferably equal to or less than 80 (g/m$^2$), and more preferably equal to or less than 75 (g/m$^2$).

The sheet s9 is the full length hoop layer provided over the full length of the shaft. Therefore, the above-mentioned effect of the flexure return is obtained over the full length of the shaft 6. The effect of the flexure return ends in the case of the partial hoop layer, and a sufficient effect is not obtained over the full length of the shaft, which is not preferable.

In light of improving the effect of the flexure return, the full length hoop layer is preferably disposed on an outer side. The full length hoop layer is preferably disposed outside a high elasticity containing bias layer (to be described later). The full length hoop layer is preferably disposed outside all the bias layers. All the bias layers and at least one full length straight layer are preferably present inside the full length hoop layer. In the embodiment of FIG. 2, all the bias layers s2 to s5 and the two full length straight layers s7 and s8 are present inside the full length hoop layer s9.

A plurality of hoop layers may be present. When the plurality of hoop layers are present, the weight of the hoop layers is increased, but the improvement effects of the crushing rigidity and the strength are not appropriate to the weight. In this respect, the hoop layer is preferably constituted with only the one full length hoop layer. In the embodiment of FIG. 2, the hoop layer is constituted with only the full length hoop layer s9.

It has become clear that the flexure return is improved by the full length hoop layer, but on the other hand, the torsional vibration of the shaft is increased. The head speed is accelerated by the improved flexure return. Since the center of gravity of the head is at a position away from the shaft axis line Z1, the torsion of the shaft is promoted by the acceleration. The promoted torsion causes an increase in the torsional vibration. The increased torsional vibration reduces the directional stability of a hit ball.

In light of suppressing the torsional vibration, the bias layer preferably includes a high elasticity containing bias layer. In the present application, the high elasticity containing bias layer means a bias layer constituted with a prepreg containing high elastic pitch-based carbon fibers having a fiber elastic modulus of equal to or greater than 80 (tf/mm$^2$). The high elastic pitch-based carbon fibers may be a part of carbon fibers included in the high elasticity containing bias layer. The high elastic pitch-based carbon fibers may be all carbon fibers included in the high elasticity containing bias layer.

In light of suppressing the torsional vibration, the fiber elastic modulus of the high elastic pitch-based carbon fiber is preferably equal to or greater than 80 (tf/mm$^2$), and more preferably equal to or greater than 90 (tf/mm$^2$). In light of the strength, the fiber elastic modulus of the high elastic pitch-based carbon fiber is preferably equal to or less than 100 (tf/mm$^2$).

The high elasticity containing bias layer is preferably constituted with a prepreg containing the high elastic pitch-based carbon fiber having a fiber elastic modulus of equal to or greater than 80 (tf/mm$^2$) and other carbon fiber having a fiber elastic modulus of equal to or less than 40 (tf/mm$^2$). Two kinds of carbon fibers are intermingled in the high elasticity containing bias layer. The prepreg containing two or more kinds of carbon fibers is also referred to as a hybrid prepreg. The use of the hybrid prepreg having the two intermingled elastic moduli can increase the strength while suppressing the torsional vibration.

Examples of the carbon fiber having a fiber elastic modulus of equal to or less than 40 (tf/mm$^2$) include a PAN-based carbon fiber and a pitch-based carbon fiber. In light of the strength, the PAN-based carbon fiber is preferable.

The high elasticity containing bias layer is preferably constituted with a prepreg containing a high elastic pitch-based carbon fiber and a PAN-based carbon fiber. By using the hybrid prepreg in which two kinds of carbon fibers are intermingled, both a high elastic modulus and high strength can be achieved. The elastic modulus of the PAN-based carbon fiber intermingled in the high elasticity containing bias layer is not limited. In light of the strength, the elastic modulus of the PAN-based carbon fiber intermingled in the high elasticity containing bias layer is preferably equal to or less than 46 (tf/mm$^2$), and more preferably equal to or less than 40 (tf/mm$^2$).

An average elastic modulus is defined for the hybrid prepreg. The average elastic modulus is the weighted average of the elastic moduli of two or more kinds of fibers. The weight percentage of each fiber is considered in the calculation of the weighted average.

In light of the flexure return, the average elastic modulus of the prepreg constituting the high elasticity containing bias layer is preferably equal to or greater than 60 (tf/mm$^2$), and more preferably equal to or greater than 65 (tf/mm$^2$). In light of the strength, the average elastic modulus of the prepreg constituting the high elasticity containing bias layer is preferably equal to or less than 80 (tf/mm$^2$), and more preferably equal to or less than 70 (tf/mm$^2$).

Based on the above, the feature of the embodiment of FIG. 2 is exemplified as follows.

[FIG. 2 (Laminated Constitution A)]

(1) The bias layers are two and the two bias layers are the first (inner) bias layer (pair) s23 and the second (outer) bias layer (pair) s45.

(2) Preferably, the carbon fiber included in the inner bias layer s23 is the PAN-based carbon fiber.

(3) Preferably, the inner bias layer s23 is not the high elasticity containing bias layer.

(4) Preferably, the prepreg constituting the inner bias layer s23 includes only one kind of fiber. Preferably, the prepreg constituting the inner bias layer s23 is not the hybrid prepreg.

(5) Preferably, the fiber elastic modulus of the inner bias layer s23 is equal to or less than 40 (tf/mm$^2$).

(6) Preferably, the carbon fiber included in the outer bias layer s45 is the PAN-based and pitch-based carbon fibers.

(7) Preferably, the outer bias layer s45 is the high elasticity containing bias layer.

(8) Preferably, the prepreg constituting the outer bias layer s45 contains two kinds of fibers. Preferably, the prepreg constituting the outer bias layer s45 is the hybrid prepreg.

(9) Preferably, the average elastic modulus of the outer bias layer s45 is equal to or greater than 60 (tf/mm$^2$).

(10) Preferably, the fiber angle of the outer bias layer s45 is less than the fiber angle of the inner bias layer s23.

(11) Preferably, the fiber angle of the outer bias layer s45 is less than 45 degrees.

(12) The hoop layer is only one full length hoop layer s9.

(13) The full length hoop layer s9 is disposed outside the high elasticity containing bias layer (outer bias layer s45).

(14) The full length hoop layer s9 is disposed outside the two bias layers (inner bias layer s23 and outer bias layer s45).

(15) The full length hoop layer s9 is disposed at a position where it is brought into contact with the outermost full length layer s10 inside the outermost full length layer s10.

The laminated constitution of FIG. 2 is also referred to as a constitution A.

Figure 3:
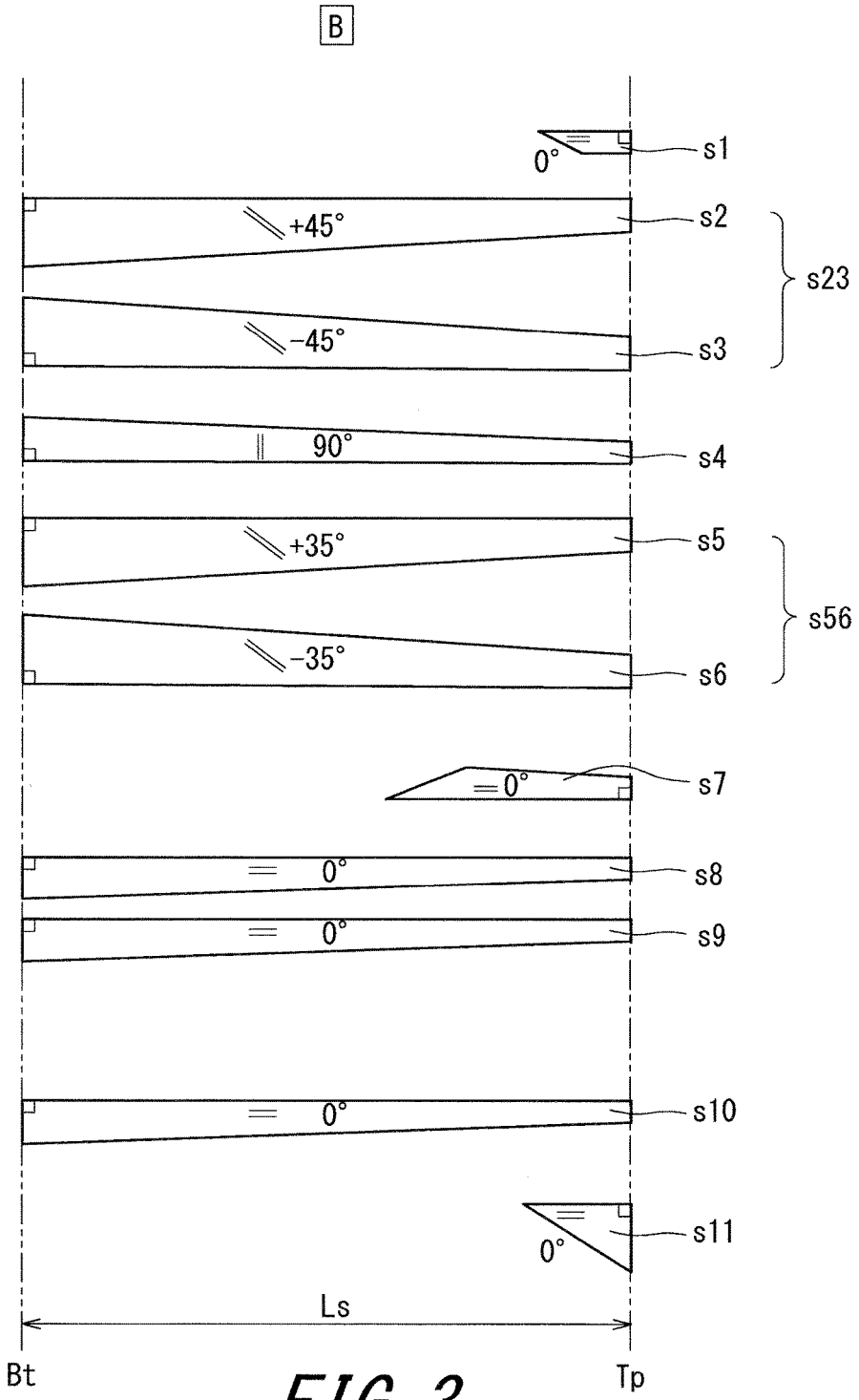
FIG. 3 is a developed view showing the laminated constitution of a shaft according to a second embodiment, and shows a laminated constitution B.

FIG. 3 shows the laminated constitution of a shaft of a second embodiment. The laminated constitution is also referred to as a constitution B.

The laminated constitution B of FIG. 3 is a constitution in which a full length hoop layer (ninth sheet s9) of FIG. 2 is moved to a fourth sheet s4. In the laminated constitution B, two bias layers are a first (inner) bias layer s23 and a second (outer) bias layer s56. A hoop layer is only one full length hoop layer s4. The full length hoop layer s4 is disposed between the inner bias layer s23 and the outer bias layer s56. The full length hoop layer s4 is disposed inside the outer bias layer s56. The full length hoop layer s4 is disposed outside the inner bias layer s23.

Figure 4:
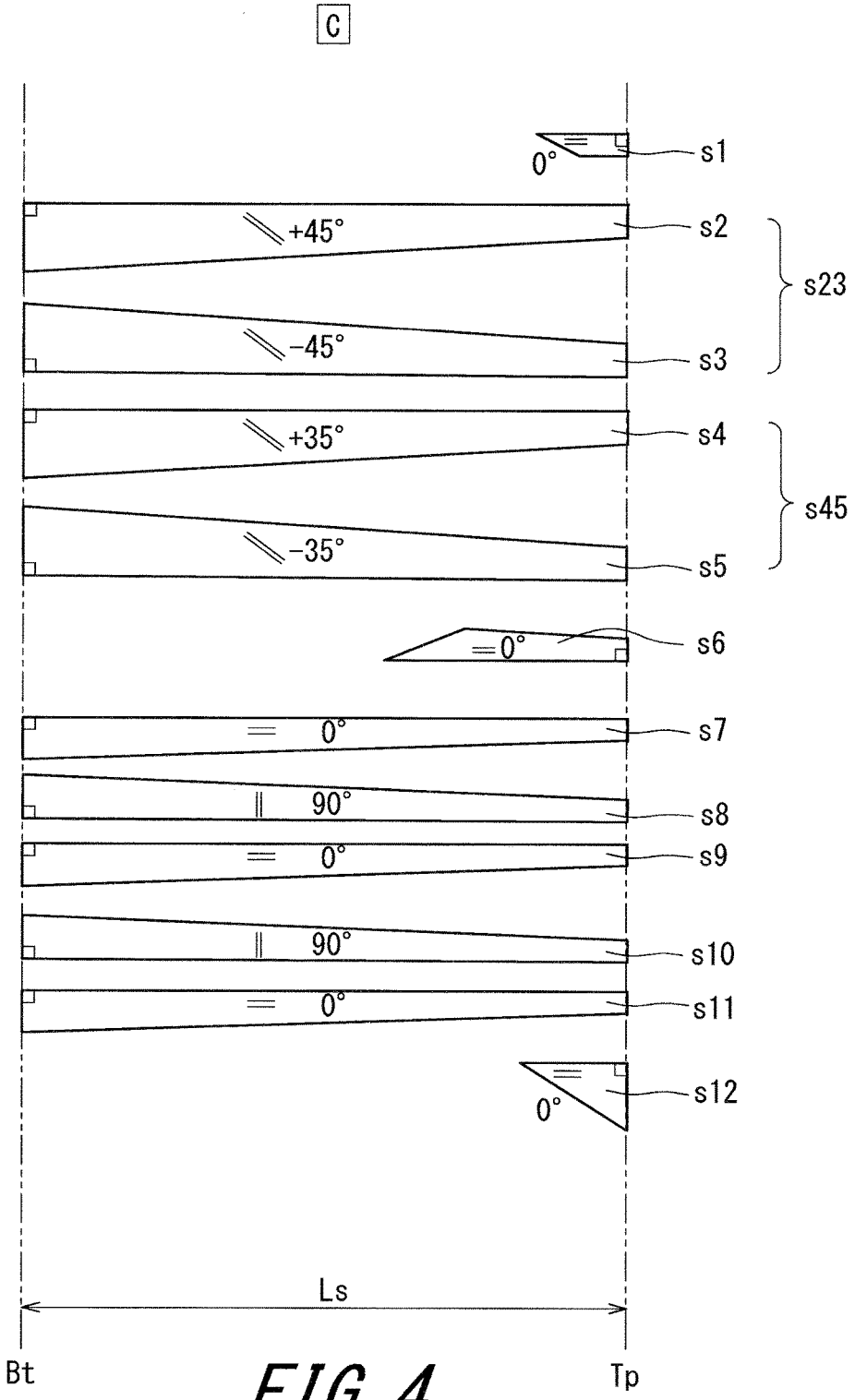
FIG. 4 is a developed view showing the laminated constitution of a shaft according to a third embodiment, and shows a laminated constitution C.

FIG. 4 shows the laminated constitution of a shaft of a third embodiment. The laminated constitution is also referred to as a constitution C.

In the laminated constitution C of FIG. 4, two full length hoop layers are present. An inner full length hoop layer is an eighth sheet s8, and an outer full length hoop layer is a tenth sheet s10. Except for these points, the laminated constitution C is the same as the laminated constitution A of FIG. 2.

In the laminated constitution C, hoop layers are the inner full length hoop layer s8 and the outer full length hoop layer s10. All the full length hoop layers s8 and s10 are disposed outside a high elasticity containing bias layer (outer bias layer s45). All the full length hoop layers s8 and s10 are disposed outside two bias layers (inner bias layer s23 and outer bias layer s45).

In the present disclosure, for example, the above-mentioned laminated constitutions A, B, and C may be employed. The evaluation of each of these laminated constitutions will be described later.

Figure 5:
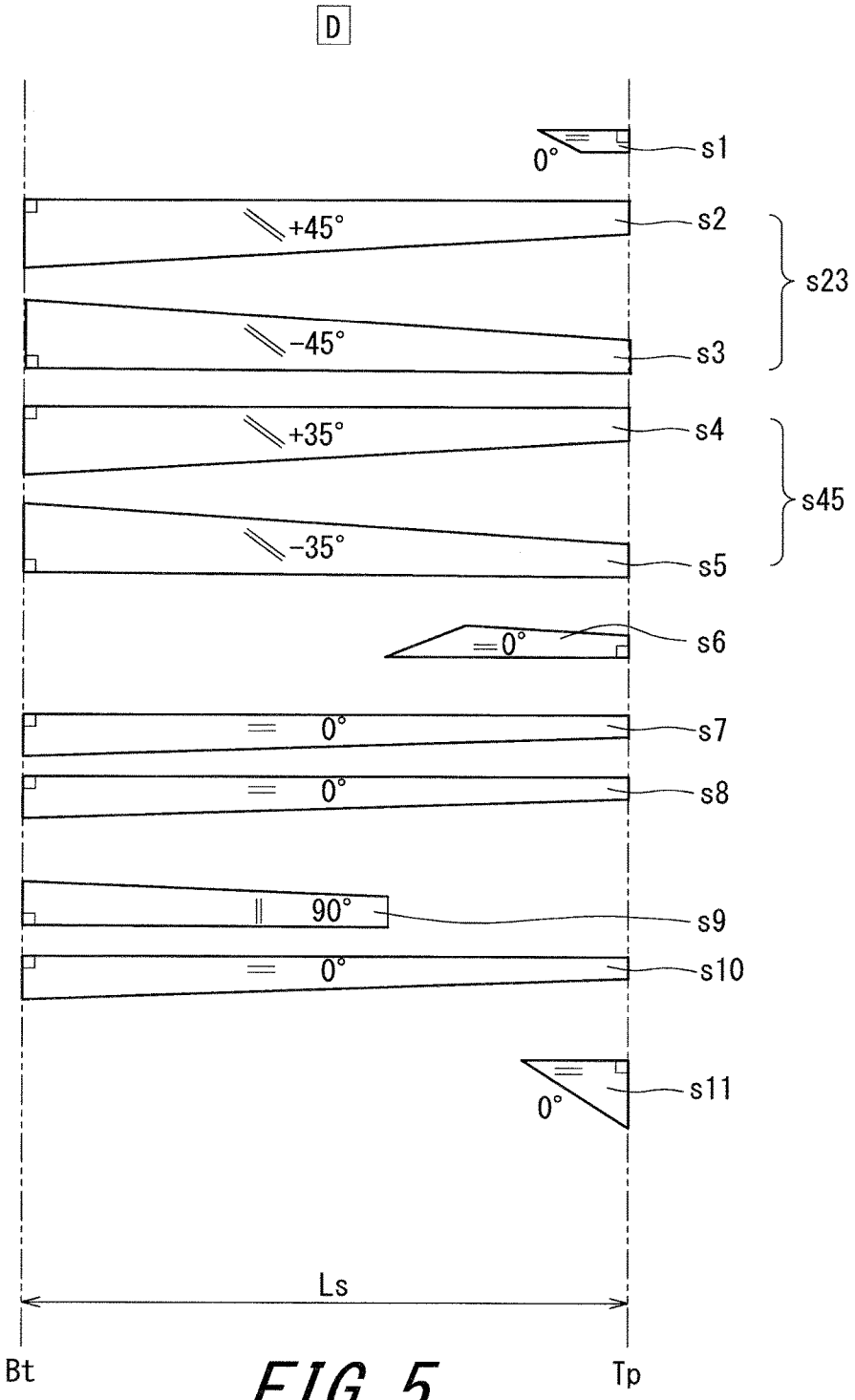
FIG. 5 is a developed view showing the laminated constitution of a shaft according to Comparative Example, and shows a laminated constitution D.

FIG. 5 shows the laminated constitution of a shaft of Comparative Example. The laminated constitution is also referred to as a constitution D.

The laminated constitution D of FIG. 5 is a constitution in which the full length hoop layer (ninth sheet s9) of FIG. 2 is changed to only a butt side partial layer. That is, a hoop layer in the laminated constitution D is not the full length hoop layer. Except for this point, the laminated constitution D is the same as the above-mentioned laminated constitution A. The evaluation of the laminated constitution will be described later.

In light of easiness of swing and a flight distance, a shaft weight is preferably equal to or less than 80 g, more preferably equal to or less than 70 g, and still more preferably equal to or less than 67 g. In light of the degree of freedom in design, the shaft weight is preferably equal to or greater than 40 g, more preferably equal to or greater than 45 g, and still more preferably equal to or greater than 50 g.

In light of obtaining a high head speed by the above-mentioned flexure return, a shaft length Ls is preferably equal to or greater than 42 inches, more preferably equal to or greater than 43 inches, still more preferably equal to or greater than 44 inches, and yet still more preferably equal to or greater than 45 inches. In light of easiness of swing, the shaft length Ls is preferably equal to or less than 48 inches, and more preferably equal to or less than 47 inches.

The following tables 1, 2, and 3 show examples of utilizable prepregs. These prepregs are commercially available.

TABLE 1

Examples of prepregs capable of being used

| Manufacturer | Trade name | Part number of fiber | Tensile elastic modulus (fiber elastic modulus) ($tf/mm^2$) | Fiber weight per unit area ($g/m^2$) | Weight per unit area of prepreg ($g/m^2$) |
|---|---|---|---|---|---|
| Toray Industries, Inc. | 3255S-5 | T700SC | 24 | 55 | 72 |
| Toray Industries, Inc. | 3255S-7 | T700SC | 24 | 75 | 99 |
| Toray Industries, Inc. | 3255S-10 | T700SC | 24 | 100 | 132 |
| Toray Industries, Inc. | 3255S-12 | T700SC | 24 | 125 | 164 |
| Toray Industries, Inc. | 3255S-15 | T700SC | 24 | 150 | 197 |
| Toray Industries, Inc. | 8053S-3A | M30SC | 30 | 25 | 36 |
| Toray Industries, Inc. | 805S-3 | M30SC | 30 | 30 | 50 |
| Toray Industries, Inc. | 8053S-3 | M30SC | 30 | 30 | 43 |
| Toray Industries, Inc. | 2255S-10 | T800S | 30 | 100 | 132 |

TABLE 1-continued

Examples of prepregs capable of being used

| Manufacturer | Trade name | Part number of fiber | Tensile elastic modulus (fiber elastic modulus) ($tf/mm^2$) | Fiber weight per unit area ($g/m^2$) | Weight per unit area of prepreg ($g/m^2$) |
|---|---|---|---|---|---|
| Toray Industries, Inc. | 2255S-12 | T800S | 30 | 125 | 164 |
| Toray Industries, Inc. | 2255S-15 | T800S | 30 | 150 | 197 |
| Toray Industries, Inc. | 17045G-5 | T1100G | 33 | 55 | 72 |
| Toray Industries, Inc. | 17045G-7 | T1100G | 33 | 75 | 99 |
| Toray Industries, Inc. | 17045G-10 | T1100G | 33 | 100 | 132 |
| Toray Industries, Inc. | 17045G-12 | T1100G | 33 | 125 | 164 |
| Toray Industries, Inc. | 9255S-7A | M40S | 40 | 69 | 91 |
| Toray Industries, Inc. | 9255S-6A | M40S | 40 | 58 | 76 |

The tensile strength and the tensile elastic modulus are measured based on "Testing methods for carbon fibers" specified on JIS R7601: 1986.

TABLE 2

Examples of prepregs capable of being used

| Manufacturer | Trade name | Part number of fiber | Tensile elastic modulus (fiber elastic modulus) ($tf/mm^2$) Average elastic moduli (individual elastic moduli in parentheses) are shown for the hybrid prepregs. | Fiber weight per unit area ($g/m^2$) | Weight per unit area of prepreg ($g/m^2$) |
|---|---|---|---|---|---|
| Nippon Graphite Fiber Corporation | E1026A-09N | XN-10 | 10 | 90 | 151 |
| Nippon Graphite Fiber Corporation | E1026A-14N | XN-10 | 10 | 140 | 222 |
| Nippon Graphite Fiber Corporation | E6026A-10S | YSH-60A | 60 | 100 | 154 |
| Nippon Graphite Fiber Corporation | NU71000-525S | YSH-70A | 70 | 100 | 133 |
| Nippon Graphite Fiber Corporation | E8026A-07S | YS-80A | 80 | 75 | 119 |
| Nippon Graphite Fiber Corporation | E9026A-07S | YS-90A | 90 | 75 | 119 |
| Nippon Graphite Fiber Corporation | E5026D-10H | YSH-60A/PAN40t | 50 (60/40) | 100 | 143 |
| Nippon Graphite Fiber Corporation | E5526D-10H | YSH-70A/PAN40t | 55 (70/40) | 100 | 143 |
| Nippon Graphite Fiber Corporation | E6026D-10H | YS-80A/PAN40t | 60 (80/40) | 100 | 143 |
| Nippon Graphite Fiber Corporation | E9426D-10H | YS-90A/PAN40t | 65 (90/40) | 100 | 143 |

The tensile strength and the tensile elastic modulus are measured based on "Testing methods for carbon fibers" specified on JIS R7601: 1986.

TABLE 3

Examples of prepregs capable of being used

| Manufacturer | Trade name | Part number of fiber | Tensile elastic modulus (fiber elastic modulus) (tf/mm$^2$) | Fiber weight per unit area (g/m$^2$) | Weight per unit area of prepreg (g/m$^2$) |
|---|---|---|---|---|---|
| Mitsubishi Rayon Co., Ltd. | GE352H-160S | E glass | 7 | 160 | 246 |
| Mitsubishi Rayon Co., Ltd. | TR350C-075S | TR50S | 24 | 75 | 100 |
| Mitsubishi Rayon Co., Ltd. | TR350C-100S | TR50S | 24 | 100 | 133 |
| Mitsubishi Rayon Co., Ltd. | TR350C-125S | TR50S | 24 | 125 | 167 |
| Mitsubishi Rayon Co., Ltd. | TR350C-150S | TR50S | 24 | 150 | 200 |
| Mitsubishi Rayon Co., Ltd. | TR350C-175S | TR50S | 24 | 175 | 233 |
| Mitsubishi Rayon Co., Ltd. | MR350C-050S | MR40 | 30 | 58 | 77 |
| Mitsubishi Rayon Co., Ltd. | MRX350C-075R | MR40 | 30 | 77 | 101 |
| Mitsubishi Rayon Co., Ltd. | MRX350C-100S | MR40 | 30 | 100 | 133 |
| Mitsubishi Rayon Co., Ltd. | MRX350C-125S | MR40 | 30 | 125 | 167 |
| Mitsubishi Rayon Co., Ltd. | MRX350C-150S | MR40 | 30 | 150 | 200 |
| Mitsubishi Rayon Co., Ltd | MRX350C-175S | MR40 | 30 | 175 | 233 |
| Mitsubishi Rayon Co., Ltd | HRX350C-075S | HR40 | 40 | 69 | 92 |
| Mitsubishi Rayon Co., Ltd | HRX350C-110S | HR40 | 40 | 100 | 132 |
| Mitsubishi Rayon Co., Ltd | HRX350C-130S | HR40 | 40 | 125 | 164 |
| Mitsubishi Rayon Co., Ltd | HSX350C-075S | HS46 | 46 | 69 | 92 |
| Mitsubishi Rayon Co., Ltd | HSX350C-110S | HS46 | 46 | 100 | 132 |
| Mitsubishi Rayon Co., Ltd | HSX350C-125S | HS46 | 46 | 116 | 155 |
| Mitsubishi Rayon Co., Ltd | HSX350C-130S | HS46 | 46 | 125 | 164 |

The tensile strength and the tensile elastic modulus are measured based on "Testing methods for carbon fibers" specified on JIS R7601: 1986.

Four kinds of hybrid prepregs are exemplified in Table 2. In each of these hybrid prepregs, the blending ratio of two kinds of carbon fibers is 1:1 in a weight ratio. Therefore, the above-mentioned average elastic modulus (weighted average) is equal to a simple average.

In trade name "E5026D-10H", YSH-60A which is a pitch-based carbon fiber of 60 (tf/mm$^2$) and a PAN-based carbon fiber of 40 (tf/mm$^2$) are intermingled in a weight ratio of 1:1. Therefore, the average elastic modulus of "E5026D-10H" is 50 (tf/mm$^2$).

In trade name "E5526D-10H", YSH-70A which is a pitch-based carbon fiber of 70 (tf/mm$^2$) and a PAN-based carbon fiber of 40 (tf/mm$^2$) are intermingled in a weight ratio of 1:1. Therefore, the average elastic modulus of "E5526D-10H" is 55 (tf/mm$^2$).

In trade name "E6026D-10H", YS-80A which is a pitch-based carbon fiber of 80 (tf/mm$^2$) and a PAN-based carbon fiber of 40 (tf/mm$^2$) are intermingled in a weight ratio of 1:1. Therefore, the average elastic modulus of "E6026D-10H" is 60 (tf/mm$^2$). "YS-80A" is a high elastic pitch-based carbon fiber. A bias layer constituted with "E6026D-10H" is a high elasticity containing bias layer.

In trade name "E9426D-10H", YS-90A which is a pitch-based carbon fiber of 90 (tf/mm$^2$) and a PAN-based carbon fiber of 40 (tf/mm$^2$) are intermingled in a weight ratio of 1:1. Therefore, the average elastic modulus of "E9426D-10H" is 65 (tf/mm$^2$). "YS-90A" is a high elastic pitch-based carbon fiber. A bias layer constituted with "E9426D-10H" is a high elasticity containing bias layer.

EXAMPLES

Hereinafter, the effects of the present disclosure will be clarified by examples. However, the present disclosure should not be interpreted in a limited way based on the description of examples.

Example 1

A shaft of Example 1 was obtained in the same manner as in the manufacturing process of the shaft 6. A shaft length was 46 inches; a shaft weight was 64 g; a forward flex was 103 mm; and a shaft torque was 3.5 degrees.

A laminated constitution of Example 1 was a laminated constitution A shown in FIG. 2. In Example 1, the following prepregs was used as sheets.

First sheet s1: "GE352H-160S" manufactured by Mitsubishi Rayon Co., Ltd.

Second sheet s2: "9255S-7A" manufactured by Toray Industries, Inc.

Third sheet s3: "9255S-7A" manufactured by Toray Industries, Inc.

Fourth sheet s4: "E9426D-10H" manufactured by Nippon Graphite Fiber Corporation Fifth sheet s5: "E9426D-10H" manufactured by Nippon Graphite Fiber Corporation Sixth sheet s6: "MRX350C-100S" manufactured by Mitsubishi Rayon Co., Ltd.

Seventh sheet s7: "MRX350C-100S" manufactured by Mitsubishi Rayon Co., Ltd.

Eighth sheet s8: "TR350C-150S" manufactured by Mitsubishi Rayon Co., Ltd.

Ninth sheet s9: "17045G-5" manufactured by Toray Industries, Inc.

10th sheet s10: "TR350C-150S" manufactured by Mitsubishi Rayon Co., Ltd.

11th sheet s11: "TR350C-100S" manufactured by Mitsubishi Rayon Co., Ltd.

A head for a driver and a grip were attached to the obtained shaft to obtain a golf club according to Example 1. A head "SRIXON 2545 driver" (loft 9.5 degrees) manufactured by Dunlop Sports Co., Ltd. was used as the head. A club length was set to 45 inches. A shaft was cut so that the club length was set to 45 inches.

Examples 2 to 12 and Comparative Examples 1 to 7

Shafts and golf clubs according to Examples 2 to 12 and Comparative Examples 1 to 7 were obtained in the same manner as in Example 1 except that laminated constitutions, prepregs of full length hoop layers, and prepregs of second bias layers (outer bias layers) were as shown in Tables. In all Examples and Comparative Examples, a shaft length was 46 inches; a shaft weight was 64 g; a forward flex was 103 mm; and a shaft torque was 3.5 degrees. The specifications and the evaluation results of Examples and Comparative Examples are shown in the following Tables 4 to 7.

TABLE 4

| Specifications and evaluation results of Examples | | | | | | |
|---|---|---|---|---|---|---|
| | Example 1 | Example 2 | Example 3 | Example 4 | Example 5 | Example 6 |
| Laminated constitution | A | A | A | A | A | A |
| Prepreg offull length hoop layer | 17045G-5 | 17045G-7 | MR350C-050S | MRX350C-075R | 9255S-6A | 9255S-7A |
| Fiber elastic modulus of full length hoop layer [tf/mm$^2$] | 33 | 33 | 30 | 30 | 40 | 40 |
| Fiber weight per unit area of full length hoop layer [g/m$^2$] | 55 | 75 | 58 | 77 | 58 | 69 |
| Prepreg of second bias layer | E9426D-10H | E9426D-10H | E9426D-10H | E9426D-10H | E9426D-10H | E9426D-10H |
| Average elastic modulus of second bias layer [tf/mm$^2$] | 65 | 65 | 65 | 65 | 65 | 65 |
| Maximum fiber elastic modulus of second bias layer [tf/mm$^2$] | 90 | 90 | 90 | 90 | 90 | 90 |
| Head speed [m/s] | 41.4 | 41.3 | 41.3 | 41.2 | 41.3 | 41.2 |
| Carry flight distance [yards] | 194.0 | 193.5 | 193.5 | 193.0 | 193.5 | 193.0 |
| Carry fall point horizontal displacement [yards] | 2.0 | 1.5 | 4.0 | 3.5 | 0.5 | 0.0 |
| Standard deviation of carry fall point horizontal displacement [yards] | 14.1 | 14.0 | 14.4 | 14.3 | 14.2 | 14.1 |
| Three-point flexural strength B point [kgf] | 100 | 95 | 99 | 94 | 97 | 96 |
| Torsional breaking strength [N · m · deg] | 1170 | 1040 | 1200 | 1050 | 1120 | 1100 |

TABLE 5

| Specifications and evaluation results of Examples | | | | | | |
|---|---|---|---|---|---|---|
| | Example 7 | Example 8 | Example 9 | Example 10 | Example 11 | |
| Laminated constitution | A | A | A | B | C | |
| Prepreg of full length hoop layer | 17045G-5 | 17045G-5 | 17045G-5 | 17045G-5 | 17045G-5 (s8) | 805S-3 (s10) |
| Fiber elastic modulus of full length hoop layer [tf/mm$^2$] | 33 | 33 | 33 | 33 | 33 | 30 |
| Fiber weight per unit area of full length hoop layer [g/m$^2$] | 55 | 55 | 55 | 55 | 55 | 30 |
| Prepreg of second bias layer | E6026D-10H | E9026A-07S | E8026A-07S | E9426D-10H | E9426D-10H | |
| Average elastic modulus of second bias layer [tf/mm$^2$] | 60 | 90 | 80 | 65 | 65 | |
| Maximum fiber elastic modulus of second bias layer [tf/mm$^2$] | 80 | 90 | 80 | 90 | 90 | |
| Head speed [m/s] | 41.4 | 41.4 | 41.4 | 41.1 | 41.2 | |
| Carry flight distance [yards] | 194.0 | 194.0 | 194.0 | 192.5 | 193.0 | |
| Carry fall point horizontal displacement [yards] | 3.0 | 2.5 | 2.0 | 5.5 | 1.0 | |
| Standard deviation of carry fall point horizontal displacement [yards] | 14.8 | 13.7 | 13.9 | 14.2 | 14.2 | |
| Three-point flexural strength B point [kgf] | 98 | 110 | 108 | 90 | 88 | |
| Torsional breaking strength [N · m · deg] | 1200 | 680 | 740 | 1050 | 1040 | |

TABLE 6

Specifications and evaluation results of Example and Comparative Examples

| | Comparative Example 1 | Comparative Example 2 | Example 12 | Comparative Example 3 | Comparative Example 4 |
|---|---|---|---|---|---|
| Laminated constitution | A | A | A | A | D |
| Prepreg of full length hoop layer | 805S-3 | 3255S-5 | HSX350C-075S | 17045G-5 | 17045G-5 |
| Fiber elastic modulus of full length hoop layer [tf/mm$^2$] | 30 | 24 | 46 | 33 | 33 |
| Fiber weight per unit area of full length hoop layer [g/m$^2$] | 30 | 55 | 69 | 55 | 55 |
| Prepreg of second bias layer | E9426D-10H | E9426D-10H | E9426D-10H | E5526D-10H | E9426D-10H |
| Average elastic modulus of second bias layer [tf/mm$^2$] | 65 | 65 | 65 | 55 | 65 |
| Maximum fiber elastic modulus of second bias layer [tf/mm$^2$] | 90 | 90 | 90 | 70 | 90 |
| Head speed [m/s] | 40.7 | 41.0 | 41.1 | 41.4 | 40.7 |
| Carry flight distance [yards] | 190.5 | 192.0 | 192.5 | 194.0 | 190.5 |
| Carry fall point horizontal displacement [yards] | 7.5 | 6.5 | −2.5 | 3.0 | 7.0 |
| Standard deviation of carry fall point horizontal displacement [yards] | 14.6 | 15.2 | 14.8 | 15.5 | 14.5 |
| Three-point flexural strength B point [kgf] | 105 | 101 | 97 | 94 | 103 |
| Torsional breaking strength [N · m · deg] | 1240 | 1210 | 1110 | 1230 | 1010 |

TABLE 7

Specifications and evaluation results of Comparative Examples

| | Comparative Example 5 | Comparative Example 6 | Comparative Example 7 |
|---|---|---|---|
| Laminated constitution | A | A | A |
| Prepreg of full length hoop layer | 17045G-10 | 17045G-5 | 17045G-5 |
| Fiber elastic modulus of full length hoop layer [tf/mm$^2$] | 33 | 33 | 33 |
| Fiber weight per unit area of full length hoop layer [g/m$^2$] | 100 | 55 | 55 |
| Prepreg of second bias layer | E9426D-10H | E6026A-10S | NU71000-525S |
| Average elastic modulus of second bias layer [tf/mm$^2$] | 65 | 60 | 70 |
| Maximum fiber elastic modulus of second bias layer [tf/mm$^2$] | 90 | 60 | 70 |
| Head speed [m/s] | Cannot be manufactured because of winding fault of hoop layer | 41.4 | 41.4 |
| Carry flight distance [yards] | | 194.0 | 194.0 |
| Carry fall point horizontal displacement [yards] | | 5.0 | 4.0 |
| Standard deviation of carry fall point horizontal displacement [yards] | | 16.0 | 15.7 |

TABLE 7-continued

Specifications and evaluation results of Comparative Examples

| | Comparative Example 5 | Comparative Example 6 | Comparative Example 7 |
|---|---|---|---|
| Three-point flexural strength B point [kgf] | | 103 | 105 |
| Torsional breaking strength [N · m · deg] | | 950 | 820 |

[Evaluation Methods]

[Ball-Hitting Test]

Ten right-handed testers hit balls. "SRIXON Z-STAR" manufactured by Dunlop Sports Co., Ltd. was used as the ball. Each of the testers hit six balls with each of the clubs.

In the ball-hitting test, a head speed, a carry flight distance, and a carry fall point horizontal displacement were measured. The carry flight distance is a flight distance at the fall point of a ball. The horizontal displacement is a distance of displacement from a target direction. The right displacement had a plus value. The left displacement had a minus value. The horizontal displacement was measured at the fall point of a ball. The average values of all shots are shown in the above Tables 4 to 7.

Standard deviation was calculated in order to evaluate the degree of variation in the horizontal displacement. The standard deviations of hittings of six balls were calculated for every tester, and were averaged. The average values are shown in the above Tables 4 to 7.

[Three-Point Flexural Strength]

Figure 6:
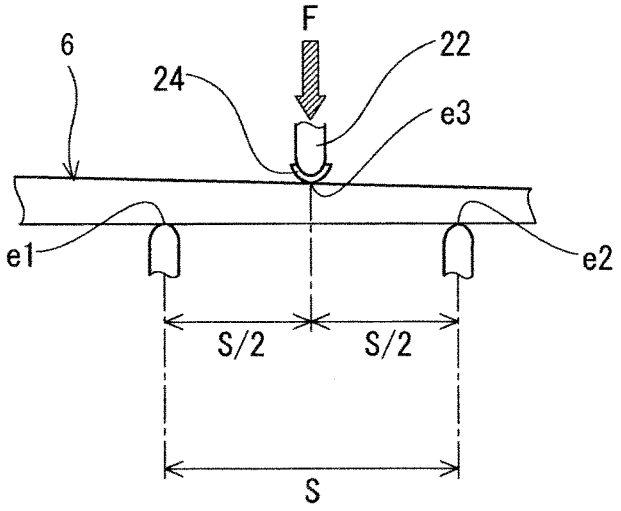
FIG. 6 is a schematic view showing a measuring method of a three-point flexural strength test.

Three-point flexural strength was measured based on an SG type three-point flexural strength test. This is a test set by Consumer Product Safety Association in Japan. FIG. 6 shows a measuring method of the three-point flexural strength test. A measured point e3 was set to a point B. The point B is a point separated by 525 mm from the tip end Tp.

As shown in FIG. 6, a shaft 6 was supported from below at two supporting points e1 and e2. A silicone rubber 24 was attached to the tip of an indenter 22. The indenter 22 was moved downward from above at a load point e3. The descending speed of the indenter 22 was 20 mm/min. The load point e3 was at a position bisecting a distance between the supporting points e1 and e2. The load point e3 is the measured point. The span S was set to 300 mm. A value (peak value) of a load F when the shaft 6 was broken was measured. The values are shown in Tables 4 to 7.

[Torsional Breaking Strength]

An SG type torsional test was employed to measure torsional breaking strength. The test is defined by Consumer Product Safety Association in Japan. In the test, fixing jigs are first bonded to both the ends of the shaft. Next, a torque was added to the shaft by rotating the tip end Tp side jig with the butt end Bt side jig fixed. The torsional breaking strength is obtained by multiplying a torque value when the shaft is broken, by a torsional angle at that time. The results are shown in the following Tables 4 to 7.

[Forward Flex]

Figure 7:
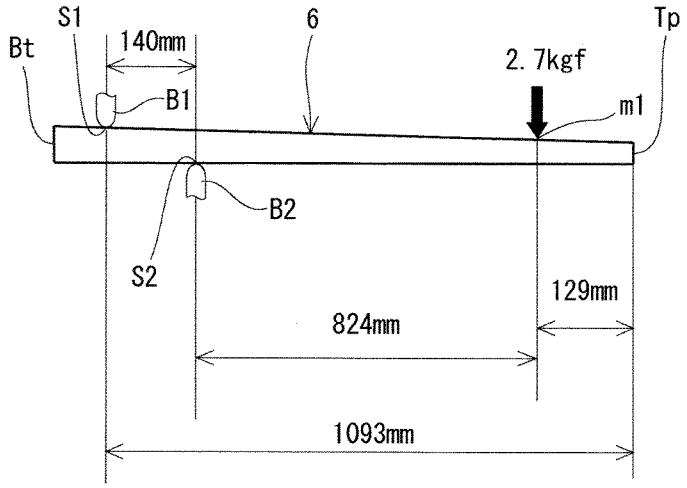
FIG. 7 is a schematic view showing a method for measuring a forward flex.

FIG. 7 shows a method for measuring a forward flex. As shown in FIG. 7, a first supporting point S1 is set at a position of 1093 mm distant from the tip end Tp. Furthermore, a second supporting point S2 is set at a position of 953 mm distant from the tip end Tp. A support B1 supporting the shaft 6 from above is provided at the first supporting point S1. A support B2 supporting the shaft 6 from the underside is provided at the second supporting point S2. In a state where no load is applied, the shaft axis line of the shaft 6 is horizontal. At a load point m1 of 129 mm distant from the tip end Tp, a load of 2.7 kgf is allowed to act in a vertical downward direction. A distance (mm) between the position of the load point m1 at a state where no load is applied and the position of the load point m1 at a state where the load is applied to settle the position is the forward flex. The distance is measured along the vertical direction.

[Shaft Torque]

Figure 8:
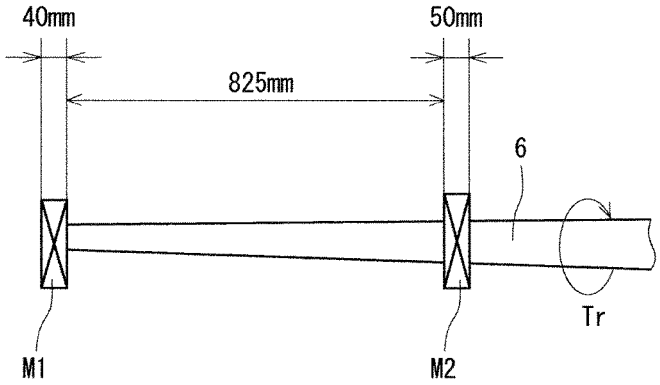
FIG. 8 is a schematic view showing a method for measuring a shaft torque.

FIG. 8 shows a method for measuring a shaft torque. A jig M1 is fixed in a width of 40 mm from the tip end Tp. The fixation is achieved by an air chuck, and the air pressure of the air chuck is 2.0 kgf/cm$^2$. A jig M2 is fixed in a width of 50 mm from a position separated by 825 mm from the jig M1. The fixation is achieved by an air chuck, and the air pressure of the air chuck is 1.5 kgf/cm$^2$. A torque Tr of 13.9 kg·cm was applied to the shaft 6 by rotating the Jig M2 while fixing the jig M1. A torsional angle due to the torque is the shaft torque.

In Example 1, a high head speed is obtained, and horizontal variation is also decreased. Example 2 is also the same. The fiber elastic modulus of the full length hoop layer in Examples 3 and 4 is slightly less than the fiber elastic modulus of the full length hoop layer in Example 1. For this reason, Example 1 has more excellent flexure return and a higher head speed than flexure return and a head speed in Examples 3 and 4.

The maximum fiber elastic modulus of the second bias layer in Example 7 is less than the maximum fiber elastic modulus of the second bias layer in Example 1. For this reason, the standard deviation of the horizontal displacement in Example 1 is less than the standard deviation of the horizontal displacement in Example 7. In other words, Example 1 has less variation in the direction of the hit ball than variation in the direction of the hit ball in Example 7, and has excellent directional stability.

In Examples 8 and 9, the hybrid prepreg is not used as the bias layer. As a result, torsional breaking strength is decreased.

In Example 10, a laminated constitution B (FIG. 3) was employed. In this Example 10, a full length hoop layer is positioned inside a second bias layer (high elasticity containing bias layer). For this reason, Example 10 has poorer flexure return and a lower head speed than flexure return and a head speed in Example 1.

In Example 11, a laminated constitution C (FIG. 4) was employed. In this Example 11, two full length hoop layers were used. A head speed was not increased even if the number of the hoop layers was increased. That is, although the number of the hoop layers was increased, the effect of flexure return was not increased. By increasing the number of the hoop layers, the weight of layers other than the hoop layer had to be reduced. This caused a decrease in three-point flexural strength.

Since the fiber weight per unit area of the full length hoop layer was decreased in Comparative Example 1, sufficient flexure return was not obtained, which caused a decrease in a head speed. Since the fiber elastic modulus of the full length hoop layer was decreased in Comparative Example 2, sufficient flexure return was not obtained, which caused a decrease in a head speed. In Example 12, the measurement of the fiber elastic modulus of the full length hoop layer caused a slight decrease in flexure return. Since the maximum fiber elastic modulus of the bias layer was decreased in Comparative Example 3, variation in a horizontal direction was increased.

In Comparative Example 4, a laminated constitution D (FIG. 5) was employed. Since the hoop layer was partially disposed, the effect of flexure return was not sufficiently obtained, which caused a decrease in a head speed.

In Comparative example 5, the fiber weight per unit area of the full length hoop layer was increased, which caused deterioration in winding property. For this reason, winding fault occurred, which caused a difficult manufacture state.

In Comparative Examples 6 and 7, the average elastic modulus of the second bias layer is equivalent to Example 1 or the like, but the high elastic pitch-based carbon fiber of equal to or greater than 80 (tf/mm$^2$) is not included. Although the average elastic modulus in these Comparative Examples is equivalent to the average elastic modulus in Example 1, variation in a horizontal direction in Comparative Examples is increased. Furthermore, in Comparative Examples 6 and 7, the torsional breaking strength is also decreased. Although the reason why such results are obtained is unknown, these results show the effect of the high elasticity containing bias layer including the high elastic pitch-based carbon fiber.

Thus, Examples have more excellent flight distance and are easier to capture as compared with Comparative Examples. The advantages of the present disclosure are apparent.

The shafts described above can be used for any golf clubs.

The description hereinabove is merely for an illustrative example, and various modifications can be made in the scope not to depart from the principles of the present disclosure.

What is claimed is:

1. A golf club shaft comprising a plurality of layers formed by fiber reinforced resins, wherein:

the plurality of layers includes a hoop layer and a bias layer;

the hoop layer includes a full length hoop layer constituted with a prepreg having a fiber elastic modulus of equal to or greater than 30 (tf/mm$^2$) and having a fiber weight per unit area of 50 (g/m$^2$) or greater but 80 (g/m$^2$) or less; and the bias layer includes a high elasticity containing bias layer constituted with a prepreg containing a high elastic pitch-based carbon fiber having a fiber elastic modulus of equal to or greater than 90 (tf/mm$^2$).

2. The golf club shaft according to claim 1, wherein the full length hoop layer is disposed outside the high elasticity containing bias layer.

3. The golf club shaft according to claim 1, wherein the hoop layer is constituted with only the one full length hoop layer.

4. The golf club shaft according to claim 1, wherein the fiber elastic modulus of the full length hoop layer is 33 (tf/mm$^2$) or greater but 40 (tf/mm$^2$) or less.

5. The golf club shaft according to claim 1, wherein the high elasticity containing bias layer is constituted with a prepreg containing the high elastic pitch-based carbon fiber having a fiber elastic modulus of equal to or greater than 80 (tf/mm$^2$) and a carbon fiber having a fiber elastic modulus of equal to or less than 40 (tf/mm$^2$).

6. The golf club shaft according to claim 1, wherein the high elasticity containing bias layer is constituted with a prepreg containing the high elastic pitch-based carbon fiber and a polyacrylonitrile-based carbon fiber.

7. A golf club shaft comprising a plurality of layers formed by fiber reinforced resins, wherein:

the plurality of layers includes a hoop layer and a bias layer;

the hoop layer includes a full length hoop layer constituted with a prepreg having a fiber elastic modulus of equal to or greater than 30 (tf/mm$^2$) and having a fiber weight per unit area of 50 (g/m$^2$) or greater but 80 (g/m$^2$) or less;

the bias layer includes a high elasticity containing bias layer constituted with a prepreg containing a high elastic pitch-based carbon fiber having a fiber elastic modulus of equal to or greater than 80 (tf/mm$^2$);

the bias layer includes inner bias layer and outer bias layer; and the outer bias layer is the high elasticity containing bias layer.

8. The golf club shaft according to claim 7, wherein the inner bias layer includes only one kind of fiber; and the outer bias layer includes two or more kinds of fibers.

9. The golf club shaft according to claim 8, wherein a fiber elastic modulus of the inner bias layer is equal to or less than 40 (tf/mm$^2$); and an average elastic modulus of the outer bias layer is equal to or greater than 60 (tf/mm$^2$).

10. The golf club shaft according to claim 7, wherein a fiber angle of the outer bias layer is less than a fiber angle of the inner bias layer.

11. The golf club shaft according to claim 7, wherein a fiber angle of the outer bias layer is less than 45 degrees.

12. A golf club shaft comprising a plurality of layers formed by fiber reinforced resins, wherein:

the plurality of layers includes a hoop layer and a bias layer;

the hoop layer includes a full length hoop layer constituted with a prepreg having a fiber elastic modulus of equal to or greater than 30 (tf/mm$^2$) and having a fiber weight per unit area of 50 (g/m$^2$) or greater but 80 (g/m$^2$) or less;

the bias layer includes a high elasticity containing bias layer constituted with a prepreg containing a high elastic pitch-based carbon fiber having a fiber elastic modulus of equal to or greater than 80 (tf/mm$^2$); and the high elasticity containing bias layer is constituted with a prepreg containing the high elastic pitch-based carbon fiber having a fiber elastic modulus of equal to or greater than 80 (tf/mm$^2$) and a carbon fiber having a fiber elastic modulus of equal to or less than 40 (tf/mm$^2$).

13. A golf club shaft comprising a plurality of layers formed by fiber reinforced resins, wherein:

the plurality of layers includes a hoop layer and a bias layer;

the hoop layer includes a full length hoop layer constituted with a prepreg having a fiber elastic modulus of equal to or greater than 30 (tf/mm$^2$) and having a fiber weight per unit area of 50 (g/m$^2$) or greater but 80 (g/m$^2$) or less;

the bias layer includes a high elasticity containing bias layer constituted with a prepreg containing a high elastic pitch-based carbon fiber having a fiber elastic modulus of equal to or greater than 80 (tf/mm$^2$); and the high elasticity containing bias layer is constituted with a prepreg containing the high elastic pitch-based carbon fiber and a polyacrylonitrile-based carbon fiber.

* * * * *